US005757133A

United States Patent [19]

Meyer et al.

[11] Patent Number: 5,757,133

[45] Date of Patent: May 26, 1998

[54] MAGNESIUM VAPOR DISCHARGE LAMP

[75] Inventors: Ronald A. Meyer, San Dimas; Michael P. Duffey; Robert A. Foss, both of Hesperia, all of Calif.

[73] Assignee: UVP, Inc., Upland, Calif.

[21] Appl. No.: 614,856

[22] Filed: Mar. 12, 1996

[51] Int. Cl.[6] ..... H01J 61/33

[52] U.S. Cl. ..... 313/610; 313/633; 313/630

[58] Field of Search ..... 313/609, 610, 313/615, 618, 633, 630, 639, 485

[56] References Cited

U.S. PATENT DOCUMENTS

| | | | |
|---|---|---|---|
| Re. 33,415 | 10/1990 | Jelic | 313/609 |
| 2,123,709 | 7/1938 | Bristow et al. | 313/610 |
| 2,306,628 | 12/1942 | Lemmers | 313/610 |
| 3,583,810 | 6/1971 | Johnson | 313/615 |
| 3,855,491 | 12/1974 | Yamasaki | 313/618 |
| 3,867,665 | 2/1975 | Furmidge et al. | 313/485 |
| 4,745,335 | 5/1988 | Ohyama et al. | 313/639 |
| 5,245,246 | 9/1993 | Bolard et al. | 313/610 |

*Primary Examiner*—Sandra L. O'Shea
*Assistant Examiner*—Michael Day
*Attorney, Agent, or Firm*—Lyon & Lyon LLP

[57] ABSTRACT

An arc lamp having a sealed lamp tube with electrodes to either side of a septum. The septum extends through the length of the arc chamber. An emissions chamber extends from the end of the arc chamber without the septum. A window at the end of the emissions chamber is displaced from the end of the septum and from the arc chamber itself by a sufficient distance so that magnesium diffusing from the electrodes does not darken the surface. The magnesium electrodes are slugs encased within high temperature cells open at one end.

8 Claims, 2 Drawing Sheets

MAGNESIUM VAPOR DISCHARGE LAMP

BACKGROUND OF THE INVENTION

The field of the present invention is magnesium lamps.

In the area of photochemical reaction science, there is frequently a need for electromagnetic radiation at specific frequencies. Several means have typically been employed to provide such radiation. First, specific wavelengths can be achieved using an arc lamp to excite a selected element having the desired wavelength. Another means to achieve a desired wavelength is to use a phosphor coating that can be excited at one wavelength by an arc lamp and in turn generates the desired wavelength. Wavelengths can be further selected by using band pass filtering.

Naturally a large number of configurations are available for arc lamps which directly transmit a selected wavelength or wavelengths. One such lamp includes a sealed tube having an arc chamber. The arc chamber is bifurcated by a septum extending substantially the full length of the tube. Electrodes are positioned to either side of the septum at one end of the tube while the septum is terminated short of the other end of the tube. Thus, a passage from one electrode to the other is created along substantially twice the length of the tube. This same lamp may employ a phosphor coating on the inside or outside surface thereof to both block out the wavelength or wavelengths generated by the arc and radiate a different wavelength dependent upon the phosphor employed.

It has been found advantageous for certain photochemical reaction science techniques to employ a radiation source having a wavelength of 285 nm. The areas of interest using a lamp emitting a 285 nm wavelength line spectrum include capillary electrophoresis, wavelength calibration equipment, industrial pollution monitoring equipment, spectroscopy and chromatography. This wavelength may be generated by a jacketed phosphor coated lamp. A number of wavelengths are generated in addition to the wavelength of 285 nm in such a lamp. These must either be tolerated or filtered to eliminate the energy not required. Additionally, phosphor lamps are subject to deterioration, discoloration and flaking of the phosphor from the lamp surface. Special handling techniques during manufacturing are also required to avoid damage to the phosphor coating. The actual manufacture of the coating is also difficult, requiring special equipment and processing to obtain a consistent coating for an even output.

Alternatively, 285 nm radiation is achieved by the excitation in an arc of magnesium. Hollow cathode magnesium lamps are available which provide the 285 nm wavelength. The radiation produced is concentrated at this wavelength such that filters and the like may be avoided. However, the size of hollow cathode lamps are substantial and make the design of equipment for photochemical reaction sciences difficult because of their size. Attempts to excite magnesium in an arc in conventional lamps results in the very active magnesium plating out on the walls of the arc cavity and completely blinding over the lamp. Once coated, a conventional arc lamp such as described above becomes useless. For this reason, small arc lamps have employed phosphor coatings with filters and the like in conjunction with a mercury arc for generating 285 nm radiation where the size of the lamp must be strictly contained.

SUMMARY OF THE INVENTION

The present invention is directed to an arc lamp generating 285 nm wavelength electromagnetic radiation in a compact unit.

In a first, separate aspect of the present invention, a sealed tube having an arc chamber with a septum employs electrodes to either side of the septum with at least one being magnesium. An emissions chamber extends from the end of the arc chamber through which 285 nm wavelength radiation is emitted.

In a second, separate aspect of the present invention, the foregoing lamp of the first, separate aspect includes an emission window being at a distance from the septum so as to be displaced from the arc created between the electrodes.

In a third, separate aspect of the present invention, cores of magnesium are employed as the electrodes in a sealed tube to either side of a septum extending the length of an arc chamber. Again, an emissions chamber extends from one end of the arc chamber through which the radiation is emitted. The cores of magnesium may be contained within shells open at one end to expose the magnesium. The shells appear to assist in the initial development of the arc.

Accordingly, it is an object of the present invention to provide a compact arc lamp having a 285 nm wavelength line spectrum directly generated by a magnesium electrode. Other and further objects and advantages will appear hereinafter.

DETAILED DESCRIPTION OF THE PREFERRED EMBODIMENT

Figure 1:
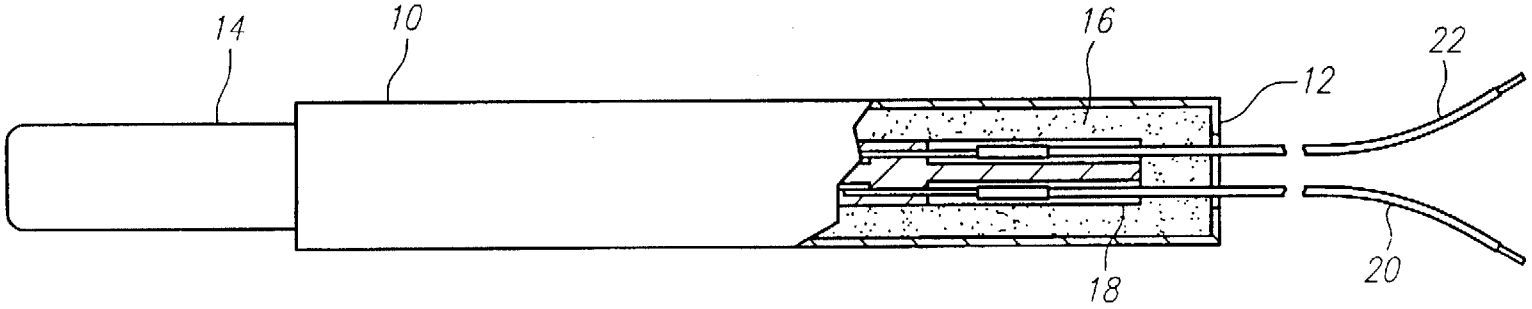
FIG. 1 is a side view, partially broken away, of a complete lamp.
Figure 2:
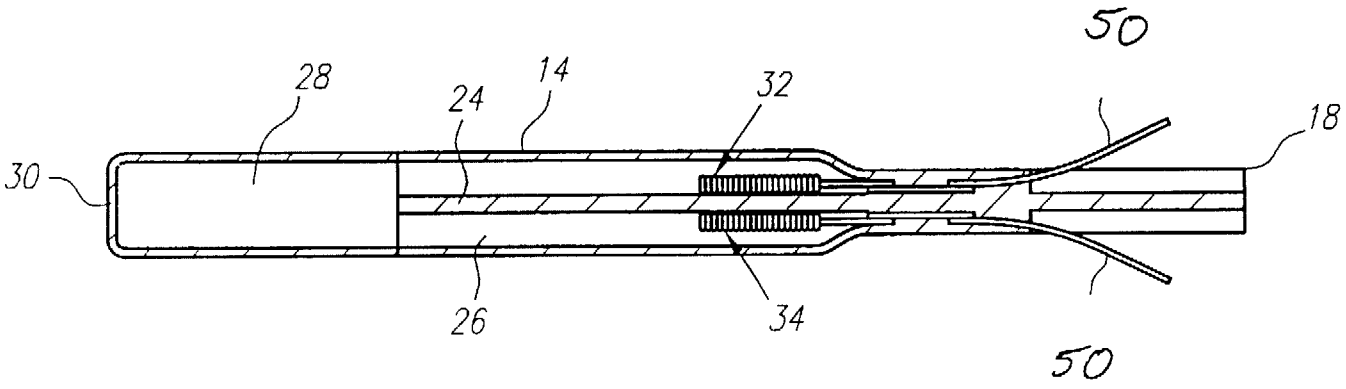
FIG. 2 is a cross-sectional side view of the lamp of FIG. 1.

Turning in detail to the drawings, FIG. 1 illustrates an assembled lamp. The lamp includes a handle or base 10 which may be of any convenient material formed in a hollow cylinder with one end fully open and another end 12 having a hole or holes for the passage of lead wires. A sealed tube 14 is positioned within the handle 10. The sealed tube 14 is retained by means of potting compound 16 which is preferably insulative and able to withstand the heat of the lamp. The foregoing configuration is conventional.

The sealed tube 14 is most preferably of quartz having the ability to transmit 285 nm wavelength radiation. The structure of the lead end 18 of the tube is also conventional. Lead wires 20 and 22 extend to the end of the tube structure where they are encased and sealed while connected to the lead assembly of the electrodes. A vacuum is drawn within the sealed tube 14 before closure.

The tube 14 includes a portion having a septum extending axially through the tube. With the septum 24, this portion of the tube 14 becomes an arc chamber 26. The arc chamber 26 extends to the free end of the septum 24. Electrodes, described in greater detail below, are positioned to either side of the septum 24 at the lead end 18 of the sealed tube 14. An elongate emissions chamber 28 extends from the end of the arc chamber 26 at the opposite end from the lead end 18. The emissions chamber 28 does not include a septum. The emissions chamber 28 is also found conveniently to be of the same minor cross section as the arc chamber 26. A closed end on the emissions chamber 28 provides an emissions window 30 shown in this embodiment to be flat with a rounded radiused intersection with the cylindrical tube. Other embodiments may have a domed window or concaved window.

Figure 3:
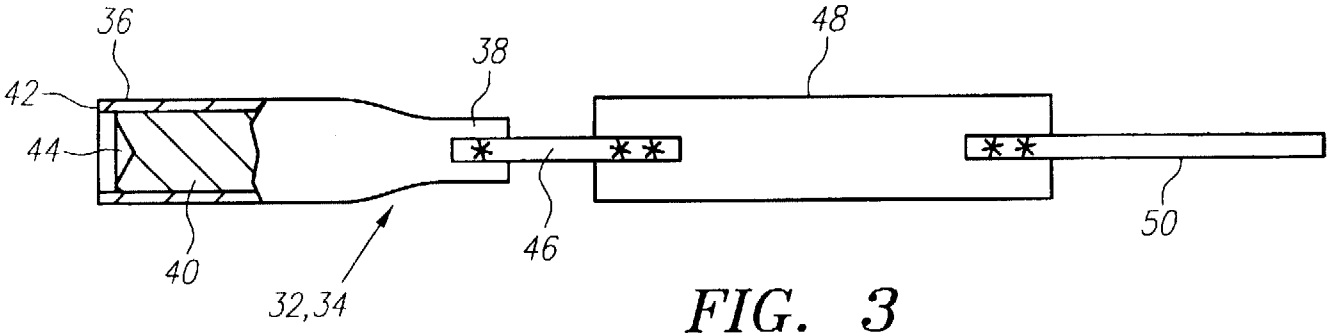
FIG. 3 is a plan view of an electrode assembly partially broken away for clarity.
Figure 4:
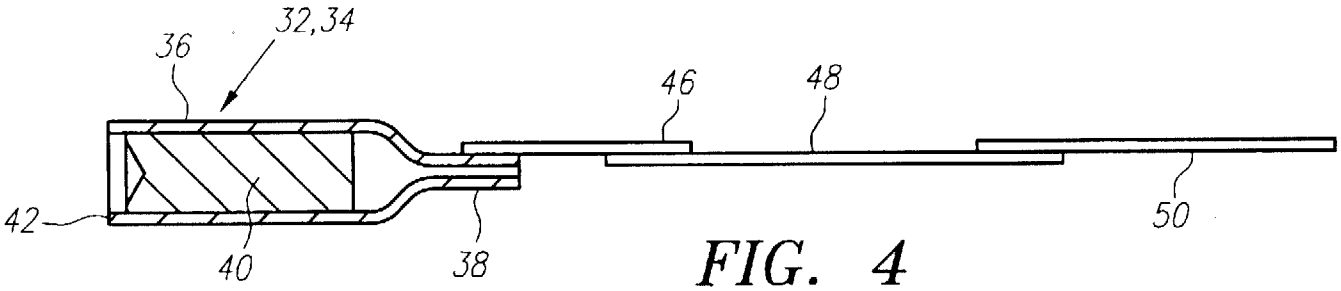
FIG. 4 is a side view of an electrode assembly partially in cross section.

Two electrode assemblies, generally designated 32 and 34 are constructed as illustrated in FIGS. 3 and 4. Molybdenum tubing, tantalum tubing or steel tubing is employed as a shell 36. The shell 36 is swaged flat at a lead end 38. A magnesium slug or core 40 is press fit into the shell from an open end 42. It is presently understood that the core 40 is preferably positioned with the open surface recessed somewhat from the edge of the open end 42 of the shell 36. A pocket 44 is formed in the end of the core 40 as a means for stabilizing the arc on the electrode. A molybdenum wire 46 is spot welded to the lead end 38 of the shell 36. As can best be seen in FIG. 3, a molybdenum sealing ribbon 48 is then attached, preferably by spot welding, to the wire 46. Finally, a molybdenum exit wire 50 is spot welded to the sealing ribbon 48 and interfaces with one of the lead wires 20 and 22. The two electrodes 32 and 34 may be constructed identically. The sealing ribbon provides a conventional means about which to heat shrink the tubing so as to insure a sealed, evacuated lamp chamber.

Turning to an understanding of the operation of the lamp, all design parameters and proportions have yet to be optimized. At this point, the emissions window 30 and the ends of the electrode assemblies 32 and 34 are placed substantially equidistant from the end of the septum 24 denoting the transition between the arc chamber 26 and the emissions chamber 28. This proportion provides a lamp of extended longevity with the emissions window 30 appearing not to be coated by the magnesium during extended operation.

When charged for the first time, an arc appears to be initiated from the shell 36 of the electrode assemblies 32 and 34 rather than from the magnesium core 40. During initial running, the electrodes are seasoned with the arcs becoming stable, emanating from the magnesium core 40. The magnesium actively coats the walls of the arc chamber such that they become opaque to the transmission of radiation from the arc. The arc extends from one electrode to the other around the end of the septum 24. The path of travel of the arc is such that it does not extend significantly into the emissions chamber.

Once stabilized, the arc emits the line spectrum for magnesium. No radiation is emitted from the tubing walls of the arc chamber 26 as these walls are coated by magnesium material from the electrodes during the seasoning process. The walls of the emissions chamber 28 are typically not coated by the magnesium material but do not appear to emit radiation at the 285 nm wavelength. It is believed that the index of refraction of the quartz forming the sealed tube 14 is such that the light being emitted by the arc is not significantly escaping through the sidewalls of the tube.

The end of the emissions chamber 28 forming the emissions window 30 radiates light at the 285 nm wavelength. The window 30 is displaced sufficiently from the arc passing around the end of the septum 24 that the magnesium does not appear to plate the window 30 even after extended use. Empirical analysis may establish that the emissions window 30 may be optimized at either a smaller or greater proportion of the total length of the tube.

Accordingly, a compact, highly useful arc lamp generating a line spectrum of magnesium at 285 nm is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A lamp comprising first and second electrodes, at least one of the first and second electrodes being magnesium;

a sealed tube including an arc chamber with a septum extending therethrough and an emissions chamber extending from an end of the arc chamber, the first electrode being on one side of the septum and the second electrode being on the other, the emissions chamber having an emissions window at one end of quartz, the emissions window being at a distance from the septum so as to be displaced from an arc between the first and second electrodes extending about the septum, the intersection of the arc chamber and the emissions chamber being substantially equidistant from the emissions window and the first and second magnesium electrodes.

2. The lamp of claim 1, the first and second electrodes being magnesium.

3. The lamp of claim 1, the sealed tube being quartz.

4. The lamp of claim 1, the emissions chamber having substantially the same minor cross section as the arc chamber.

5. A lamp comprising first and second electrodes, at least one of the first and second electrodes being magnesium;

a sealed tube including an arc chamber with a septum extending therethrough and an elongate emissions chamber extending from an end of the arc chamber, the first electrode being on one side of the septum and the second electrode being on the other, the emissions chamber having an emissions window at one end, the intersection of the arc chamber and the emissions chamber being substantially equidistant from the emissions window and the first and second electrodes.

6. The lamp of claim 5, the first and second electrodes being magnesium.

7. The lamp of claim 5, the emissions chamber being sufficiently extended to inhibit magnesium plating on the emissions window.

8. The lamp of claim 5, the first and second electrodes each including a core of magnesium and a surrounding shell open at one end to expose an end of the core of magnesium.

* * * * *